US005150010A

United States Patent [19]

Kageyama

[11] Patent Number: 5,150,010

[45] Date of Patent: Sep. 22, 1992

[54] DISCHARGE-IN-MAGNETIC-FIELD TYPE ION GENERATING APPARATUS

[75] Inventor: Katsuhiro Kageyama, Yokosuka, Japan

[73] Assignee: Kabushiki Kaisha Toshiba, Kawasaki, Japan

[21] Appl. No.: 669,025

[22] Filed: Mar. 13, 1991

[30] Foreign Application Priority Data

Mar. 14, 1990 [JP] Japan ..... 2-62912

[51] Int. Cl.[5] ..... H01J 33/00

[52] U.S. Cl. ..... 315/111.81; 250/423 R; 313/359.1

[58] Field of Search ..... 315/111.81, 111.21, 315/111.41; 250/423 R, 492.3; 313/359.1

[56] References Cited

U.S. PATENT DOCUMENTS

| | | | |
|---|---|---|---|
| 4,344,019 | 8/1982 | Gavin et al. | 250/423 R X |
| 4,423,355 | 12/1983 | Kageyama | 315/111.81 |
| 4,933,551 | 6/1990 | Bernius et al. | 315/111.81 X |
| 5,015,920 | 5/1991 | Blanchard | 315/111.81 |

FOREIGN PATENT DOCUMENTS

| | | |
|---|---|---|
| 58-157036 | 9/1983 | Japan . |
| 59-87738 | 5/1984 | Japan . |
| 59-111230 | 6/1984 | Japan . |
| 59-121746 | 7/1984 | Japan . |

OTHER PUBLICATIONS

Abstracts of the divisional meeting of the Physical Society of Japan, pt. 4, p. 109; K. Kageyama et al; Oct. 2, 1990.

*Primary Examiner*—Eugene R. LaRoche
*Assistant Examiner*—D. Hyun Yoo
*Attorney, Agent, or Firm*—Oblon, Spivak, McClelland, Maier & Neustadt

[57] ABSTRACT

A crossed-field triode discharge type ion generating apparatus, containing a vacuum container, a magnetic field generating unit, a positive pole having a hollow part, a first negative pole, a second negative pole having an ion injecting hole, a control electrode, and a means of giving the highest electric potential among ones for all the electrodes to the positive pole and higher electric potential than ones for the first negative pole and the second negative pole to the control electrode, has at least either of the control electrode or the second negative pole constructed out of a cylinder possessing a through hole coaxial with the hollow part of the positive pole and a platelike part provided on one end of the cylinder, the cylinder being provided with a part made of at least one kind of metal belonging to a group of metals including vanadium, chrome, niobium, molybdenum, tantalum and tungsten and at least one of the control electrode, the first negative pole or the second negative pole being also provided with a part made of titanium.

11 Claims, 13 Drawing Sheets

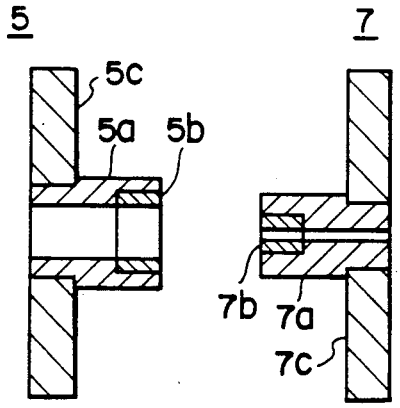
FIG. 5A
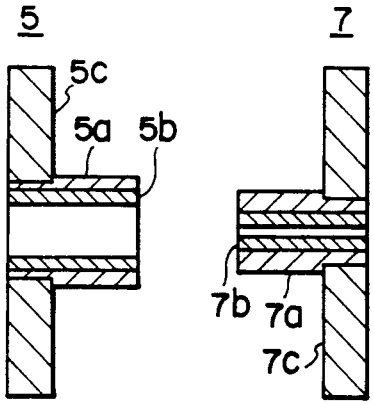
FIG. 5C
FIG. 5B
FIG. 5D
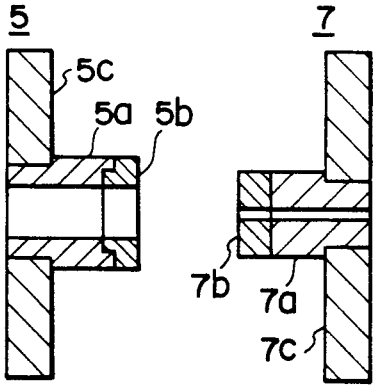
FIG. 5E
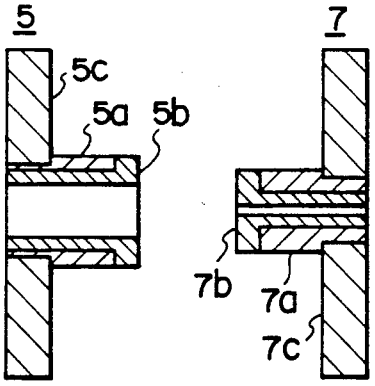
FIG. 5G
FIG. 5F
FIG. 5H
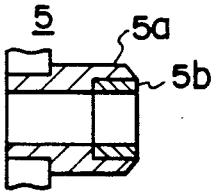
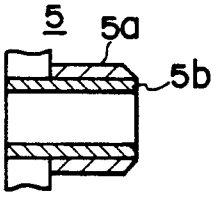
FIG. 5I
FIG. 5J

DISCHARGE-IN-MAGNETIC-FIELD TYPE ION GENERATING APPARATUS

BACKGROUND OF THE INVENTION

1. Field of the Invention

The present invention relates to a discharge-in-magnetic-field type, (more specifically, crossed-field discharge type) ion generating apparatus use as an ion source in a mass spectrograph, and in surface analyzing equipment and the like.

2. Description of the Related Art

Generally, the ion generating apparatus has been used as a device of implanting ions into semiconductor and an ion source for various kinds of accelerators. In addition to such applications, the ion generating apparatus has been utilized to ionize atoms and molecules for analysis by a gas analyzer mounted to a vacuum equipment, and for surface analyzing equipment for solid.

Many ion generating apparatuses utilize a discharge either a DC discharge or an AC discharge. A characteristic of the device utilizing the DC discharge is stability. In order to generate a DC discharge, a positive pole and a negative pole are needed. With temperature of the negative pole as the criterion, the DC discharge may be classified into hot cathode and a cold cathode type. The ion generating apparatus, having no high temperature part whose DC discharge is the cold cathode type, is featured by a minimized wear of the negative pole and a longer life of the apparatus.

"Penning discharge type" is found as a typical example of the cold cathode DC discharge type ion generating apparatus. The Penning discharge the discharge occurs in gas whose pressure has been decreased and is a "crossed-field discharge", wherein the discharge is performed between the positive pole of positive potential, having a hollow part, which is put in a magnetic field and the negative pole of negative potential which is disposed to cover 2 opening parts of the afore-mentioned hollow part. Where the discharge substantially occurs, an electric field and the magnetic field are perpendicular jointed to each other, electrons are confined in the electric and magnetic fields, a group of electrons is formed, and collision between molecules of the gas and the electrons cause the molecules to be ionized. The ions are generated in the space where a group of the electrons exists, i.e. in the discharge space, and are injected through a through hole made in a position of the negative pole corresponding to the center line of the hollow part of the positive pole. Thus, the Penning discharge type ion generating apparatus supplies the ions to the outside.

If the through hole is made in the negative pole, the penning discharge may be unstabilized. In that case, a state of instability of the Penning discharge can be avoided, if the electric potential of one negative pole at which the ion injecting hole is located can be made lower enough compared with the other negative pole in which the injecting hoe is not found, or if the electric potential of substance placed close to and just outside of the ion injecting hole lower than that of the negative pole of the ion generating apparatus, so any specified problem is avoided. However, the Penning discharge type ion generating apparatus faces still the following problem:

The given solid (object) is placed at the position, opposite to the ion injecting hole, of the negative pole in which the ion injecting hole is not found and surface of the solid is irradiated by the ions occurring during the discharge, thereby sputtering substances from the surface of the solid. A method of ionizing the neutral particles, emitted by the sputtering, by the discharge is utilized as a sputtering type ion source. An official gazette of Japanese patent unexamined application No. SHO (59)-121746 (hereinafter referred to as document 1) discloses a possibility of utilizing also such a method for means of analyzing the surface of a solid.

It is possible to realize the afore-mentioned method using a Penning discharge, but the requirement for that case is, as mentioned above, that the electric potential of the negative pole at which the solid to be sputtered is located shall be made higher than that of the negative pole at which the through hole is located. But under such a method, energy of the incident irons into the surface of the solid to be sputtered cannot reach the level being required for increasing the sputtering ratio as much as possible. Therefore, the device using the Penning discharge cannot increase value of the output ionic current in the case of the sputtering type ion source (equipment), while it cannot make analytical sensitivity higher in the case of the surface analyzer. In order to solve such conventional problems as mentioned above, the document 1 discloses a crossed-field triode discharge, wherein a control electrode is added to a group of electrodes for the Penning discharge.

FIG. 12 is a longitudinal sectional view of the principal part of the surface analyzer referred to in the document 1, rewritten for the purpose of emphasizing its gist only without a change of its technical content.

FIG. 13 is a power connection diagram illustrating a relationship of the electric potentials among the electrodes. For a purpose of simplicity only, all the drawings in the specification employ the same reference characters common to the corresponding parts.

Thus, the ion generating apparatus in use for the surface analyzer of FIG. 12 generates the ions from the surface substance of the sample. After some parts of the generated ions pass through the ion injecting hole 8 made in the 2nd negative pole 7, an incidence of them into an ion mass separator 9 is made and each current value of the ions whose mass has been separated is measured by an ion current measuring device 10. The specified method is employed to change the ions' mass being separated and the ions' mass and the ion's current are set against one another, thereby performing an ions' mass spectrometry, by which a surface analysis of the sample 6*a* is in turn executed.

FIG. 13 specifies no grounding point in an illustrated manner. The variants of a mode of setting the grounding points are considered to be subject to its relationship with the ion mass separator 9 and, whichever variants are selected, any influence of them upon an actuation of the ion generating apparatus by itself which uses the crossed-field triode discharge may not take place. With the ion generating apparatus of the afore-mentioned construction, an electric potential of the discharge space is determined mainly by the electric potentials of the control electrode 5 and the positive pole 3, if both the electric potentials of the two negative poles 6 and 7 are sufficiently lower than that of the control electrode 5, so that there is no relation between the discharge space and the electric potentials of the two negative poles 6 and 7. A variation in kinetic energy of the ions incident upon the negative poles 6 and 7 is subject to a difference between the electric potential of the discharge space and the electric potentials of the negative poles 6 and 7. For this reason, if the kinetic energy of the ions incident upon the negative poles 6 and 7 is desired to settle within somewhat larger value, it may be optionally established so that it becomes possible to set the sputtering ratio of the substance in the negative pole to higher level, so the afore-mentioned problem that the sputtering ratio cannot be increased, when the Penning discharge is used, may be solved.

Nevertheless, the ion generating apparatus using the crossed-field triode discharge still faces such a problem of impurity irons. A description of the problem is made in conjunction with FIG. 12 in the context of an example of an ion generating apparatus for the surface analyzer.

The ions which have been generated in the discharge space irradiate the control electrode 5 and the 2nd negative pole 7 in addition to the sample 6*a*, whereby each surface substance of the control electrode 5 and the 2nd negative pole 7 is sputtered to be emitted into the discharge space, and, similarly to the surface substance of the sample, the former substance is ionized, the resulting ions are injected from the ion injecting hole 8 and their mass is to be analyzed, such a result of the mass analysis of the ions working a background of the surface analysis of the sample. Since the background makes ordinarily a ratio between a signal of the surface analysis of the sample and a noise (SN ratio) smaller, a sensitivity of the analysis may be unavoidably limited to lower level. Furthermore, because the ions of the surface substance of the control electrode 5 and the 2nd negative pole 7 are not ones of the surface substance of the sample, the former ions are the impurity ions. As a result, the impurity ions are detrimental to the surface analysis of the sample. A reduction in amount of the impurity ions and an increase in the SN ratio have been demanded. Similarly, since there occurs also such a problem as a mixture of the impurity ions into an output ion current, if the crossed-field triode type ion generating apparatus is used as the sputtering type ion source equipment, a need exists to reduce an amount of the impurity ion.

Thus, if the conventional Penning discharge type ion generating apparatus, having the solid substance to be ionized arranged on the negative pole, is used as a sputtering type ion source, a sputtering ratio of the solid substance to be ionized cannot be enlarged, so the value of output ion-beam current cannot be increased. If the conventional apparatus is used as the surface analyzer with the sample undergoing surface analysis, being disposed on the negative pole, also for the afore-mentioned reason, the analysis sensitivity is limited.

Although the afore-mentioned problems incurred by the Penning discharge type ion generating apparatus are solved by the crossed-field triode discharge type ion generating apparatus, if the crossed-field triode is used as the sputtering type ion source, the impurity ions which are generated from the surface substance of the control electrode and the 2nd negative pole are mixed in the output ion-beam, while if it is used as a surface analyzer, a limit of the SN ratio of the analysis to smaller value decreases in turn the analysis sensitivity.

SUMMARY OF THE INVENTION

The primary object of the present invention is to provide an ion generating apparatus, making improvements in the crossed-field triode discharge type ion generating apparatus, wherein an amount of impurity ions being generated from the surface substance of the control electrode and the 2nd negative pole can be reduced.

Another object of the present invention is to provide the surface analyzer, to which the aforementioned ion generating apparatus is applied so that the surface analyzer may enlarge the SN ratio of the analysis and put its higher analysis sensitivity into full play.

A further object of the present invention is to provide the ion source equipment, to which the aforementioned ion generating apparatus is applied so that the ion source equipment may generate gas ions minimizing impurities and increasing the gas efficiency. Associated with this object, it is included into the object of the present invention to provide an apparatus for generating ions of solid origin and capable of reducing the amount of impurity ions contained by ion-beams which are injected from the ion injecting hole.

A still further object of the present invention is to provide the mass spectrometer whose SN ratio and sensitivity are enhanced by application of the afore-mentioned ion generating apparatus.

The crossed-field triode discharge type ion generating apparatus of the present invention, which is made to attain the afore-mentioned objects and to solve the related problems, includes a vacuum container, a magnetic field generating unit, a group of electrodes comprising the positive pole having a hollow part, a 1st negative pole having the rodlike piece, a 2nd negative pole having an ion injecting hole, and a control electrode, and a means of furnishing the positive pole with a highest electric potential of all the electrodes and supplying the control electrode with an electric potential which is higher than both the electric potentials for the 1st and 2nd negative poles, has at least either of the control electrode or the 2nd negative pole constituted by a cylinder with the through hole running coaxially with the hollow part of the positive pole and a platelike piece mounted to one end of the cylinder and is characterized in that the cylinder has a part made of at least one kind of metal belonging to a group of metals such as vanadium, chromium, molybdenum, tantalum and tungsten, and at least one of the control electrode, the 1st negative pole, or the 2nd negative pole has a part made of titanium.

An enumeration of the preferred embodiments according to the present invention may be made as follows:

(a) A cylinder has an annular part, facing the through hole and being more near to the side of the positive pole, made of at least one kind of metal belonging to the afore-mentioned group of metals and other part made of material being mainly constituted by the titanium;

(b) An outer periphery, being more near to the outer periphery side than the annular part, which belongs to one of parts other than such an annular part of the cylinder as referred to in Item (a), has its parts more near to the side of the positive pole made thinner in a proportional manner and other part more near to the side of the platelike piece made more thick in the same manner;

(c) At least either of an inner periphery facing the through hole or the annular part being near to the side of the positive pole of the cylinder is made of at least one kind of metal belonging to the afore-mentioned group of metals and at least part, more near to the side of the platelike piece, of the outer periphery includes part which is made of the material mainly constituted by titanium;

(d) Such an outer periphery of the cylinder as referred to in Item (a) has its part being more near to the side of the positive pole made thinner in a proportional manner and the afore-mentioned part more near to the side of the platelike piece made more thick in the same manner;

(e) The cylinder is constructed to have the part being made of at least one kind of metal belonging to the afore-mentioned group of metals and the part being made of the material which is mainly constituted by titanium arranged in an alternative manner toward a azimuth direction of the through hole;

(f) Among the part of Item (e) being made of the material which is constituted mainly by the titanium, a part more near to the side of the positive pole is made thinner in proportional manner;

(g) Among the part being made of the material which is constituted mainly by the titanium, a part being more near to the side of the positive pole is made shorter than a part, made of at least one kind of metal belonging to the afore-mention group of metals, which is more near to the side of the positive pole;

(h) The part, near to the side to the platelike piece, of the cylinder is constructed to have a part being made of at least one kind of metal belonging to the afore-mentioned group of metals and a part being made of the material which is constituted mainly by the titanium arranged in an alternative manner toward an azimuth direction of the through hole and the annular part, more near to the side of the positive pole, of the cylinder has its full circumference made of at least one kind of metal belonging to the afore-mentioned group of metals; and (i) The cylinder is made of alloy of the titanium and the niobium. According to other embodiment of the present invention, the crossed-field triode discharge type ion generating apparatus of the afore-mentioned basic construction may solve the pertained problems by forming a sectional area of the section taken perpendicularly to the magnetic field of the ion injecting hole such that a sectional area of the part more near to the side of the hollow part of the positive pole becomes larger than a sectional area of the other part, more near to the hollow part of the positive pole, which is located at the inside of the 2nd negative pole.

The ion source equipment for generating the gas ions, using the ion generating apparatus of the present invention is constructed to combine the ion generating apparatus with a gas supply line for supplying the gas to the hollow part of the positive pole and an ion-beam forming part which is arranged by way of the 2nd negative pole on the side opposite to the positive pole and in vicinity of the ion injecting hole of the 2nd negative pole.

Similarly, the ion source equipment for generating ions of solid origin is constructed to combine the afore-mentioned ion generating apparatus with the gas supply line for supplying the gas to the hollow part of the positive pole, the ion-beam forming part which is arranged by way of the 2nd negative pole on the side opposite to the positive pole and in vicinity of the ion injecting hole of the 2nd negative hole, and substance to be ionized which is arranged on a location, facing the hollow part of the positive pole, of the rodlike piece of 1st negative pole.

The mass spectrometer using the ion generating apparatus of the present invention is constructed to combine the afore-mentioned ion generating apparatus with a means of supplying gas to be analyzed to the hollow part of the positive pole and a means of analyzing ion mass being arranged by way of the 2nd negative pole on the side opposite to the positive pole and in vicinity of the ion injecting hole of the 2nd negative pole.

The surface analyzer using the ion generating apparatus of the present invention is constructed to combine the afore-mentioned ion generating apparatus with a means of supplying gas to the hollow part of the positive pole and a means of analyzing ion mass being arranged by way of the 2nd negative pole on the side opposite to the positive pole and in vicinity of the ion injecting hole of the 2nd negative pole, executing the surface analysis of substance being disposed on the location wherein the rodlike piece of the 1st negative pole faces the hollow part of the positive pole.

The afore-mentioned metal belonging to a group of metals including vanadium, chromium, niobium, molybdenum, tantalum and tungsten is featured by that its sputtering ratio is smaller. From that view, an application of at least one kind of metal belonging to the afore-mentioned group of metals to the cylinder of the control electrode or the 2nd negative pole for the triode discharge, to which an impact of primary ions being generated by the discharge is given in the most severe manner, will reduce amount of substance, supplied to the discharge space, which will become the impurity ions so that amount of the impurity ions to be generated will be decreased.

In addition, since at least one of the control electrode, the 1st negative pole, and the negative pole includes a part made of titanium, adhering force of the attachment, formed onto the surface of the element, e.g. the inner wall of the positive pole, by the sputtering, is increased so that a separation of the attachment hardly takes place, whereby amount of impurity ions being generated by such a separation is also decreased.

If the sectional area of the section taken perpendicularly of the magnetic field of the ion injecting hole has a sectional area of a part located at a side of hollow port formed larger than that of another part near to said hollow part in the inside of said second negative pole. The amount of injecting impurity ions, among ions being generated in the discharge space, through the ion injecting hole is decreased.

It is apparent from the afore-mentioned description that the ion generating apparatus of the present invention allows the reduction in amount of the generated impurity ions to enlarge the SN ratio of the analysis, enhancing the analytical sensitivity, if it is incorporated into the surface analyzer, forms the beam of the gas ions which decrease the impurities, being higher in gas efficiency, if incorporated into the gas ion source equipment, decreases amount of the impurity ions contained by the ion beam which is injected through the ion injecting hole, if incorporated into the sputtering type device of generating ions of solid origin, and enables an analysis to be higher in SN ratio and in sensitivity, if incorporated into the mass spectrometer.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 5-A to 5-J are sectional views of the constructed examples of the control electrode and the 2nd negative pole which constitute the principal parts of the present invention;

DETAILED DESCRIPTION OF THE PREFERRED EMBODIMENTS

Figure 1:
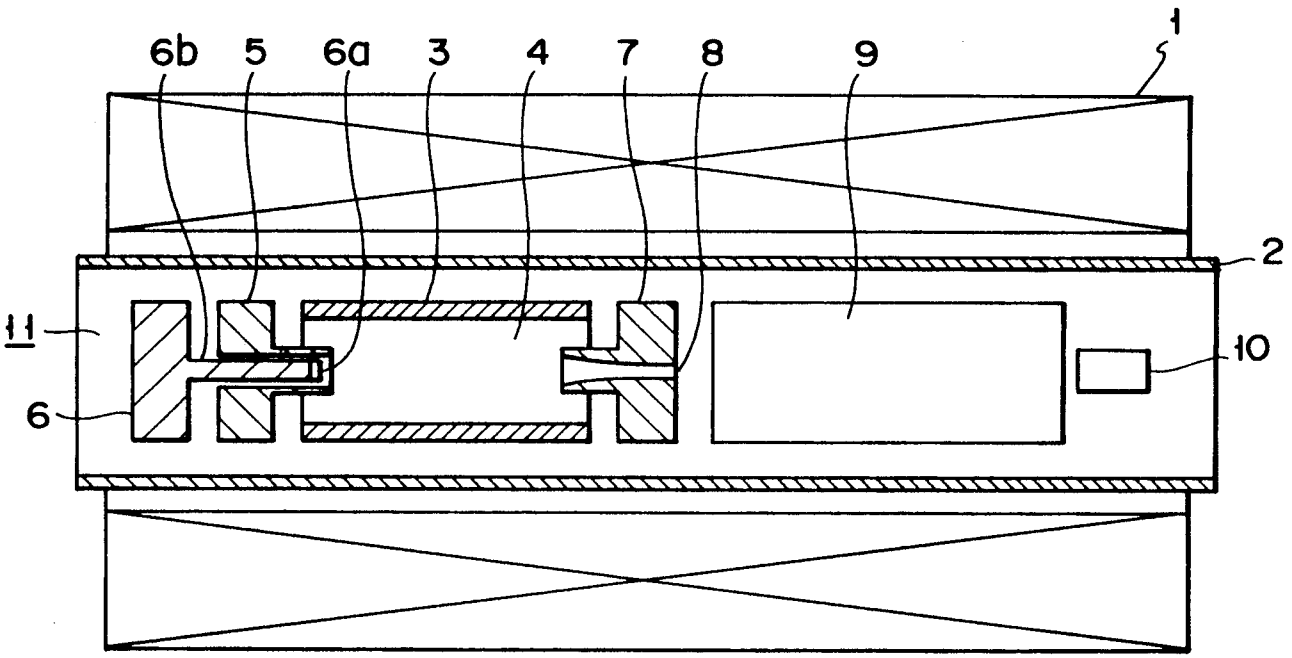
FIG. 1 is a block diagram of the surface analyzer of the 1st embodiment using the ion generating apparatus according to the present invention.

FIG. 1 illustrates one example of applying, as the 1st embodiment of the present invention, the ion generating apparatus to the surface analyzer. In the Figure, the principal part of the ion generating apparatus is shown in a manner of a longitudinal sectional view, while other parts thereof are shown in a manner of a block diagram.

Referring to FIG. 1, the electromagnet 1 gives rise to the magnet field in the inside of the vacuum container 2. The air is exhausted from the vacuum container 2, which is connected to a vacuum equipment (not shown). The positive pole 3 is disposed in the aforementioned magnetic field. The positive pole 3, having the through hollow part (hereinafter referred to as hollow part of positive pole) 4, is adapted to make the center line of the hollow part of the positive pole 4 in parallel with a direction of the magnetic field. The 1st negative pole 6 is disposed to be opposite to one opening of the hollow part of the positive pole 4, parting from the positive pole 3. The 1st negative pole 6 becomes coaxial with the center line of the hollow part of the positive pole 4 and has the rodlike piece 6*b* extending to the positive pole 3. The 2nd negative pole 7 is disposed to be opposite to another opening of the positive pole 3, also parting from the positive pole 3. The 2nd negative pole 7 have the ion injecting hole 8 located at the position of joining it to the center line of the hollow part of the positive pole 4. The control electrode 5, parting from both of the negative pole 6 and the positive pole 3, is disposed between the positive pole 3 and the 1st negative pole 6. The positive pole 3, the control electrode 5, the 1st negative pole 6 and the 2nd negative pole 7 constitute a group of discharge electrodes 11. A sample 6*a* to undergo the surface analysis is mounted to the top end of the rodlike piece 6*b* of the 1st negative pole 6. When discharge phenomenon takes place, the sample 6*a* shares partially with the 1st negative pole 6 in the action.

The ion generating apparatus, the ion mass separator 9 being disposed by way of the 2nd negative pole 7 to be opposite to the positive pole 3 and in vicinity of the ion injecting hole 8 of the 2nd negative pole 7, and the ion current measuring unit 10 constitute the means of analyzing ion mass.

Figure 2:
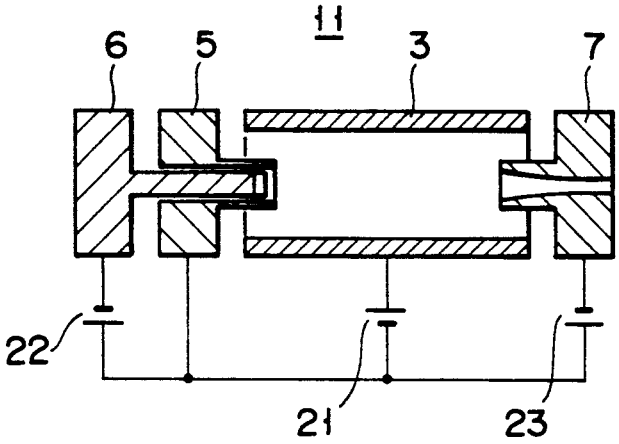
FIG. 2 is a power connection diagram illustrating a relationship among electric potentials of electrodes belonging to a group of discharge electrodes of FIG. 1.

FIG. 2 is a power connection diagram illustrating the relationship among the electric potentials of the electrodes belonging to a group of discharge electrodes 11. It is constructed that the power 21 causes the electric potential, highest among the electric potentials for all the electrodes, to be given to the positive pole 3, and the powers 22 and 23 permit the electric potentials, both of which are lower than that for the control electrode 5, to be given to the 1st negative pole 6 and the 2nd negative pole 7 respectively, namely the control electrode 5 being provided with the electric potential, higher than both of them for the 1st negative pole 6 and the 2nd negative pole 7. FIG. 2 does not show the grounding points. The variant of a grounding method is subject to considerable relation with the ion mass separator 9 (see FIG. 1) and, in principle, whichever grounding methods are employed, they do not give any marked influence to the action of the ion generating apparatus wherein the crossed-field triode discharge is used.

In the surface analyzer as shown in FIG. 1, the discharge in the ion generating apparatus is performed among the electrodes belonging to a group of discharge electrodes 11 by means of a group of electrons confined in the hollow part of the positive pole 4. Namely, the magnetic field, generated in parallel with the center line of the hollow part of the positive pole 4 by the electromagnet 1, incurs a state where the electrons cannot easily reach the positive pole 3 and the electrical potential barrier, made by the control electrode 5 and the two negative poles 6 and 7, causes the electrons not to reach easily these electrodes in a parallel with the magnetic field, so the electrons are confined in the hollow part of the positive pole 4, such electrons being united as a group of electrons, which maintain the discharge. The space where a group of electrons exist is the "discharge space".

The gas molecules, whose density is about equal to that in high vacuum area or ultra-high vacuum area, exist in the discharge space. The gas molecules are ionized by the electrons. Some portions of the generated ions irradiate the sample 6*a*, thereby performing the sputtering process, and the substance on the surface of the sample 6*a* is emitted. The emitted substances are largely neutral particles such as atoms. An incidence of many of the emitted neutral particles into the discharge space is made and, furthermore, many neutral particles incident in to the discharge space are ionized by the electrons constituting the afore-mentioned group of electrons.

Thus, the ion generating apparatus in use for the surface analyzer in accordance with the present embodiment allows the ions of the substance from the surface of the sample 6*a* to be generated. Some portions of the generated ions pass through the ion injecting hole 8 made in the 2nd negative pole 7 and they become incident into the ion mass separator 9, the current value of the mass-analyzed ions being measured by the ion current measuring unit 10. The mass-separated ions are changed by the given method so that the ion mass may be set against the ion current, and the mass-analysis of such ions is performed, whereby the surface analysis of the sample 6*a* is executed.

In the ion generating apparatus of the aforementioned construction, if both of the electric potentials of the negative poles 6 and 7 are sufficiently lower than that of the control electrode 5, the electric potential of the discharge space is determined mainly by the electric potential of the control electrode 5 and that of the positive pole 3 and any interaction between the electric potentials of the negative poles 6 and 7 and that of the discharge space hardly takes place. In addition, the kinetic energy of the ions incident into the negative poles 6 and 7 is determined by a difference between the electric potential of the discharge space and those of the negative poles 6 and 7. For this reason, the kinetic energy of the ions incident into the negative poles 6 and 7 can be optionally set, if it is desired to settle at somewhat larger value, thereby enabling sputtering yield of the substance in the negative poles to be increased.

Figure 3:
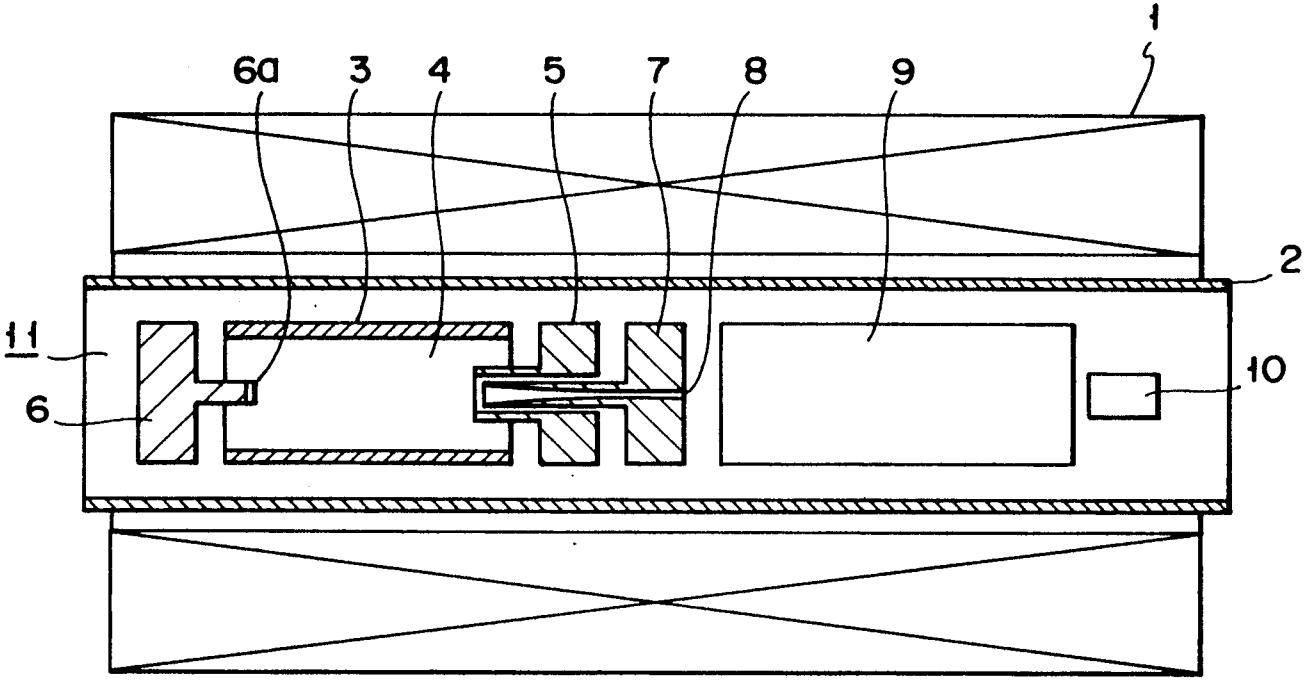
FIG. 3 is a block diagram of the surface analyzer of the 2nd embodiment using the ion generating apparatus according to the present invention.

FIG. 3 is a block diagram of the surface analyzer of the 2nd embodiment using the ion generating apparatus according to the present invention. Similarly to FIG. 1, the principal part of the ion generating apparatus is shown in a manner of a longitudinal sectional view, while other parts are shown in a manner of a block diagram. According to the 2nd embodiment, the ion generating apparatus is different from such an apparatus as shown in FIG. 1. A different point is that the ion generating apparatus of FIG. 1 has the control electrode 5 interposed between the positive pole 3 and the 1st negative pole 6, while FIG. 3 has the control electrode 5 interposed between the positive pole 3 and the 2nd negative pole 7. Similarly to the prior example, the positive pole 3, the control electrode 5 the 1st negative pole 6 and the 2nd negative pole 7 constitute a group of discharge electrodes 11. Although the relationship among the electric potentials of the electrodes belonging to a group of discharge electrodes 11 is not shown in the Figure, it is the same as shown in FIG. 2.

Figure 4:
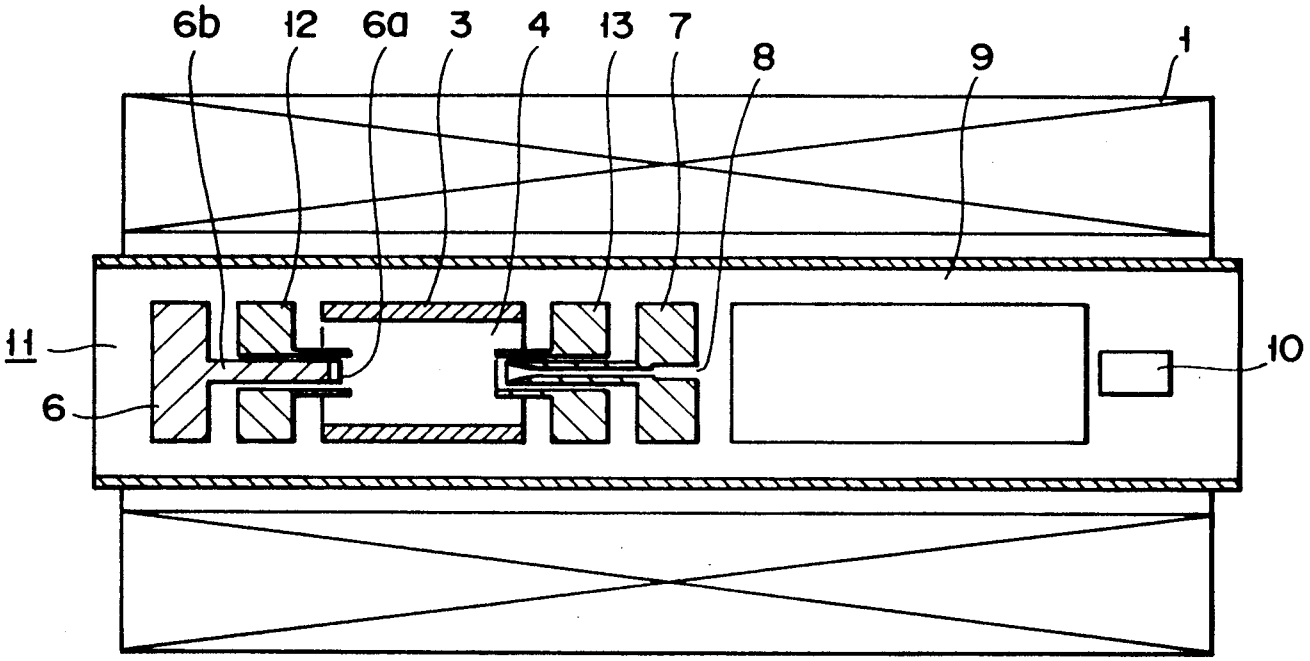
FIG. 4 is a block diagram of the surface analyzer of the 3rd embodiment using the ion generating apparatus according to the present invention.
Figures 6A, 6B, 6C, 6D, 6E:
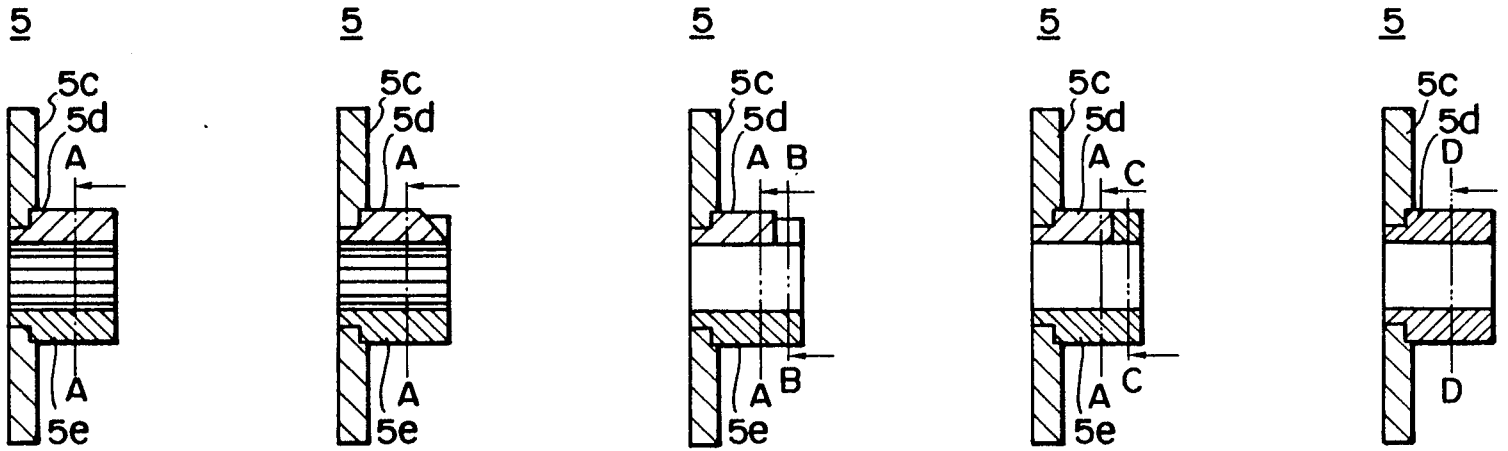
FIGS. 6-A to 6-J are sectional views of another constructed examples of the control electrode and the 2nd negative pole which constitute the principal parts of the present invention.
Figure 6F:
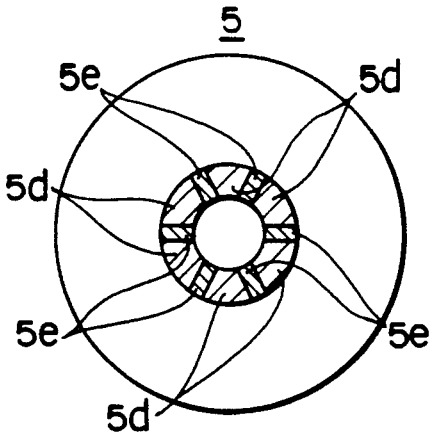
Figure 6G:
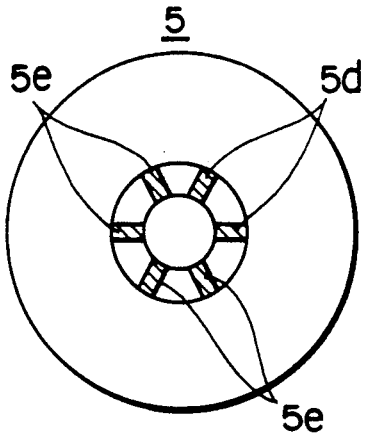
Figure 6H:
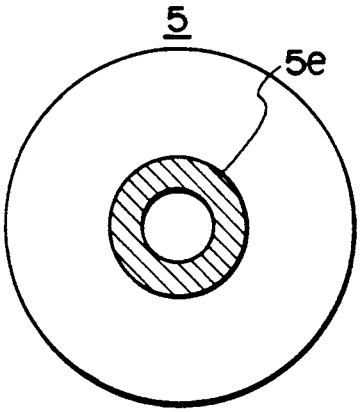
Figure 6I:
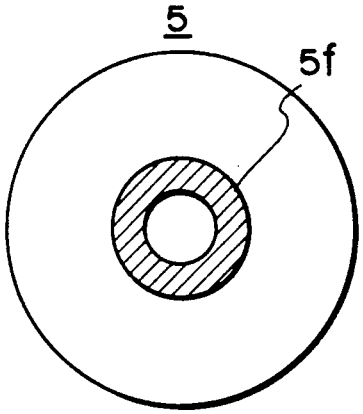
Figure 6J:
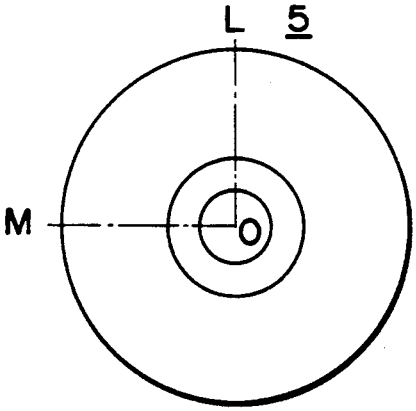
Figure 7A:
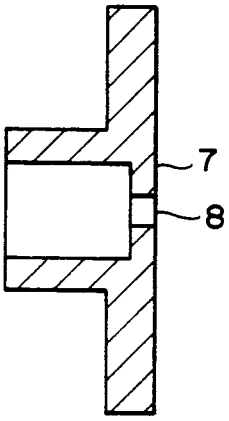
FIGS. 7-A to 7-E are sectional views of further constructed examples of the 2nd negative pole which constitutes the principal part of the present invention.
Figure 7B:
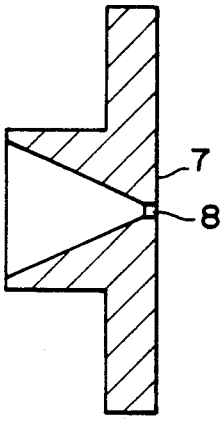
Figure 7C:
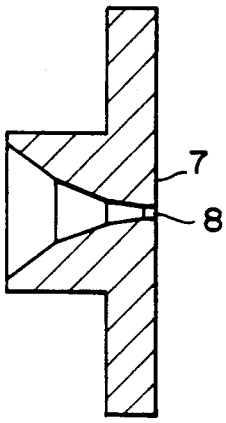
Figure 7D:
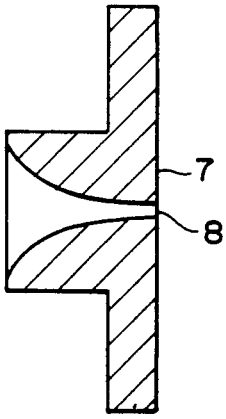
Figure 7E:
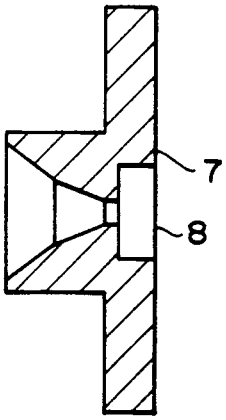

FIG. 4 is a block diagram of the surface analyzer of the 3rd embodiment using the ion generating apparatus according to the present invention. Similarly to FIG. 1, the principal part of the ion generating apparatus is shown in a manner of a longitudinal sectional view, while other parts of thereof are shown in a manner of a block diagram. A different point between such an ion generating apparatus as shown in FIG. 4 and those of FIGS. 1 and 3 lies in providing the two control electrodes 12 and 13 in the former case. The 1st control electrode 12 is interposed between the positive pole 3 and the 1st negative pole 6 and the 2nd control electrode 13 is interposed between the positive pole 3 and the 2nd negative pole 7. The positive pole 3, the 1st control electrode 12, the 2nd control electrode 13, the 1st negative pole 6 and the 2nd negative pole 7 constitute a group of discharge electrodes 11. Although a relationship among the electric potentials of the electrodes belonging to the group of discharge electrodes 11 is not shown therein, assuming that the electric potentials of the control electrodes 12 and 13, equal to each other, are also equal to that of control electrode 5 of FIG. 2, other electrodes 3, 6 and 7 are the same as shown in FIG. 2.

Referring now to FIGS. 5-A to 5-J, all of which illustrate constructions of the principal part of the present invention in details, FIGS. 5-A, 5-C, 5-E, 5-G, 5-I and 5-J are longitudinal sectional views of the specified examples of the control electrode 5, while FIGS. 5-B, 5-D, 5-F and 5-H are longitudinal sectional views of the specified examples of the 2nd negative pole 7.

In FIGS. 5-A, 5-C, 5-E, 5-G, 5-I and 5-J, 5*a* is a pipelike part, 5*b* is an annular part, 5*c* is a platelike part, and the pipelike part 5*a* and the annular part 5*b* constitute the cylinder of the control electrode 5 having the through hole which is coaxial with the center line of the hollow part 4 of the positive pole. In FIGS. 5-B, 5-D, 5-F and 5-H, 7*a* is a pipelike part, 7*b* is an annular part, 7*c* is a platelike part, and the pipelike part 7*a* and the annular part 7*b* constitute the cylinder of the 2nd negative pole 7 having the through hole which is coaxial with the center line of the hollow part 4 of the positive pole 4.

The pipelike part 5*a* of the control electrode is made of material mainly comprising titanium, the annular part 5*b* is made of at least one group of metal belonging to a group (hereinafter referred to as group R) of metals including vanadium, chromium, niobium, molybdenum, tantalum and tungsten, the pipelike part 7*a* of the 2nd negative pole 7 is made of mainly comprising titanium, (e.g. such a titanium-alloy as niobic titanium), and the annular part 7*b* is made of at least one kind of metal belonging to the group R.

It may be accepted that the construction of such two control electrodes 12 and 13 as shown in FIG. 4 is identical to that of such control electrodes as shown in FIGS. 5-A to 5-J.

As mentioned above, the problem which is required to be solved by the present invention lies in reducing amount of the impurity ions which are to be generated from the surface substance of the control electrode 5 (or 12 and 13) and the 2nd negative pole 7. A reason for generating the impurity ions is to sputter the surface substance of the control electrode 5 (or 12 and 13) and the 2nd negative pole 7, by an impact of the ions being generated with the discharge upon such a surface substance. According to the afore-mentioned 1st to 3rd embodiments of the present invention, an application of the metal, belonging to the group R, which is smaller in sputtering ratio, to the cylinders of the control electrode 5 (or 12 and 13) and the 2nd negative pole 7 to which the most severe impact of the ions is given causes amount of the impurity ions to be generated to be reduced.

The discharge permits the substance on the surface of the 1st negative pole, the 2nd negative pole, and the control electrode to be sputtered. The sputtered surface substance is adhered to the solid surface such as an inner wall of the positive pole 3 and the like and accumulates there. When the accumulated attachment may be sometimes separated from the solid surface and, in turn, it enters into the discharge space, a great amount of impurity ions is generated. As a countermeasure against that, the 1st to the 3rd embodiments have at least one of the control electrode and the 2nd negative pole constructed such that it has a portion containing titanium. Such a construction causes the attachment accumulating on the solid surface of the inner wall of the positive pole 3 to be mixed with titanium, whereby adhering force of the accumulating attachment to the solid surface is reinforced. As a result, a frequency of generating the impurity ions after the accumulating attachment was separated to enter into the discharge space can be decreased.

A specific description of such examples as shown in FIGS. 5-A to 5-J is made as follows: In FIGS. 5-A and 5-B, first of all, among constituent elements of the cylinders of the control electrode 5 and the 2nd negative pole 7, the annular parts 5*b* and 7*b*, more near to the side of the positive pole 3 of the part, (namely, the inner wall of the cylinder), facing the through hole, are made of at least one kind of metal belonging to the group R. Other constituent parts of the cylinders, i.e. the pipelike parts 5*a* and 7*a* are made of material mainly comprising titanium. In the control electrode 5 and the 2nd negative pole 7, the parts to which the impact of ions is given in the most severe manner are parts having the cylinders faced with the through hole, i.e. the annular parts 5*b* and 7*b* which are more near to the side of the positive pole 3 of the inner wall of the cylinders. An application of at least one kind of metal belonging to the group R being smaller in the sputtering ratio to the afore-mentioned annular parts 5*b* and 7*b* will enable amount of impurity ions to be generated to be reduced.

Regarding FIGS. 5-C and 5-D, inner peripheries, facing the through hole, of the cylinders of the control electrode 5 and the 2nd negative pole 7 are made of at least one kind of metal belonging to the group R. On the other hand, the outer peripheries thereof are made of titanium. Thus, an application of at least one kind of metal belonging to the group R to the inner peripheries, facing the through hole, of the cylinders, to which the impact of ions is given in the most severe manner, will enable amount of impurity ions to be generated to be reduced.

In FIGS. 5-E and 5-F, the annular parts, more near to the side of the positive pole 3, of the cylinders of the control electrode 5 and the 2nd negative pole 7 are made into annular shape, using at least one kind of metal belonging to the group R, and portions, more near to the sides of the platelike parts 5*c* and 7*c*, of the cylinders are made into annular shape, using titanium. As mentioned above, an application of at least one kind of metal belonging to the group R to the annular parts 5*b* and 7*b*, more near to the side of the positive pole 3, of the cylinder to which impact of the ions is given in the most severe manner will enable amount of impurity ions to be generated to be reduced.

In FIGS. 5-G and 5-H, the cylinders of the control electrode 5 and the 2nd negative pole 7 have their inner parts facing the through hole and their annular parts 5*b* and 7*b* being more near to the side of the positive pole 3 made into annular shape, while at least one kind of metal belonging to the group R is used and the annular parts, more near to the side of the platelike 5*c*, which are located around the outer peripheries of the cylinders, are made of titanium. Thus, an application of at least one kind of metal belonging to the group R to almost all the parts to which the impact of ions is given in the most severe manner, namely the parts facing the through hole, and the parts, more near to the side of positive pole 3, of the cylinders of the control electrode 5 and the 2nd negative pole 7 will enable amount of the impurity ions to be generated to be reduced in more effective manner.

In FIG. 5-I, of the part, facing the through hole, of the cylinder of the control electrode 5, i.e. the side of the inner wall of the cylinder, the annular part 5*b* being more near to the side of the positive pole 3 is made of at least one kind of metal belonging to the group R and other parts 5*a* of the cylinder is made of material mainly comprising titanium. Furthermore, among other parts 5*a* of the cylinder, the part, located around the outer periphery, of the annular part 5*b* is formed thinner together with an advance toward its portion more near to the side of the positive pole 3 in proportional manner and more thick together with an advance toward its portion more near to the side of the platelike part 5*c* (not shown) in the same manner. As mentioned above, an application of at least one kind of metal belonging to the group R to the part, more near to the side of the positive pole 3, which is located around the inner wall of the cylinder, receiving impact of the ions in the most severe manner, will enable amount of the impurity ions to be generated to be reduced.

In addition to that among the parts made of the material mainly comprising titanium, the part more near to the side of the positive pole 3, which is located around the outer periphery of the cylinder is adapted to be of such a form that it becomes thinner together with an advance toward its side more near to the side of the positive pole 3 in a proportional manner and more thick together with an advance toward its sides more near to the sides of the platelike parts 5*c* and such a construction is in a position to prevent the sputtered impurity particles such as titanium from making an access to the center line of the hollow part 4 of the positive pole. Since almost all the ions which pass through the ion injecting hole 8 are generated in the vicinity of the center line of the hollow part of the positive pole 4, such a shape of the cylinder as shown in FIG. 5-I enables amount of impurity ions which pass through the ion injecting hole 8 to be reduced to a large extent.

In FIG. 5-I illustrating an example of the control electrode 5, an application of the same construction as mentioned above to the 2nd negative pole 7 will obtain the same effect as mentioned above and obtained in the case of afore-mentioned construction of the control electrode 5.

In FIG. 5-J, the part, facing the through hole, of the cylinder of the control electrode 5, i.e. the side of the inner wall 5*b* of the cylinder, is made of at least one kind of metal belonging to the group R and the side of the outer periphery 5*a* of the cylinder is made of material mainly comprising titanium. As mentioned above, an application of at least one kind of metal belonging to the group R to the part, facing hole, of the cylinder to which impact of the ions is given to the most severe manner reduces amount of impurity ions being generated. Furthermore, of the part made of the material mainly comprising titanium, a shape of the portion located at the side of the positive pole 3 is formed thinner together with an advance toward such a portion as more near to the positive pole 3 in a proportional manner and more thick together with an advance toward such a portion as more near to the platelike part 5*c* (not shown) in the same manner, whereby the sputtered impurity particles such as titanium are constructed to be prevented from making an access to the center line of the hollow part of the positive pole 4. Similarly to such a case as shown in FIG. 5-I, the afore-mentioned construction will enable amount of the impurity ions, which pass through the ion injecting hole 8, to be reduced to a large extent.

In FIG. 5-J illustrating an example of the control electrode 5, an application of the same construction to the 2nd negative pole will obtain the same effect as obtained in the case of the afore-mentioned construction of the control electrode 5.

FIGS. 6-A to 6-J illustrate other constructions, different from (afore-mentioned) constructions of FIGS. 5-A to 5-J, of the control electrode 5 constituting the principal part of the present invention in details: FIGS. 6-A, 6-B, 6-C 6-D and 6-E are longitudinal sectional views, FIGS. 6-F, 6-G, 6-H and 6-I are cross-sectional views, and FIG. 6-J shows a phase of the section of each longitudinal sectional view. Namely, FIGS. 6-A, 6-B, 6-C, 6-D and 6-E are longitudinal views taken from such a section as shown by chain line L-O-M of FIG. 6-J. FIG. 6-F is a cross-sectional view taken from such a section A-A as shown in FIGS. 6-A to 6-D in an arrow direction, FIG. 6-G is a cross-sectional view taken from such a section B-B as shown in FIG. 6-C in an arrow direction, FIG. 6-H is a cross-sectional view taken from such a section C-C as shown in FIG. 6-D in an arrow direction and FIG. 6-I is a cross-directional view taken from such a section D-D as shown in FIG. 6-E in an arrow direction.

In FIGS. 6-A to 6-I illustrating the control electrode 5, 5*c* is the platelike part, 5*d* is the part, made of material mainly comprising titanium, of the cylinder, 5*e* is the part, made of at least one kind of metal belonging to the group R including vanadium, chromium, niobium, molybdenum, tantalum, and tungsten, of the cylinder and 5*f* is the cylinder made of alloy of titanium and niobium.

FIG. 6-A and FIG. 6-F show that the cylinder of the control electrode 5 is made of disposing alternately the part made of material mainly comprising titanium and the part made of at least one kind of metal belonging to the group R in an azimuth direction of the through hole. According to this example, an application of the metal, smaller in sputtering ratio, which belongs to the group R, to the cylinder of the control electrode to which impact of the ions is given reduces amount of the generated impurities and a provision of the part, mainly comprising titanium, around the cylinder of the control electrode 5 constructs the attachment being generated by the sputtering to be unable to be easily separated, thereby reducing a frequency of generating the impurity ions.

FIG. 6-B and FIG. 6-F show that the cylinder of the control electrode 5 is made of disposing alternately the part made of material mainly comprising titanium and the part made of at least one of kind of metal belonging to the group R and a portion, located at the side of the positive pole 3, of the former part is formed thinner together with an advance toward its segment more near to the side of the positive pole 3 in a proportional manner. According to this example, an application of the metal, smaller in sputtering ratio, which belongs to the group R, to the cylinder of the control electrode 5 to which impact of the ions is given, reduces amount of generated impurities. Similarly, a provision of the part, made mainly of titanium, around the cylinder of the control electrode 5 as well as a formation of making its portion, more near to the side of the positive pole 3, thinner in a proportional manner construct the attachment, formed by the sputtering, to be unable to be easily separated and cause a reduction in amount of sputtering segments of the part mainly comprising titanium toward the side of the center line of the positive pole to decrease occurrence of the impurities which take place around the afore-mentioned part.

FIG. 6-C, FIG. 6-F and FIG. 6-G show that the cylinder of the control electrode 5 is made of disposing alternately the part made of material mainly comprising titanium and the part made of at least one kind of metal which belongs to the group R in an azimuth direction of the through hole and a portion, near to the side of the positive pole 3, of the former part is constructed to be shorter in length than another portion, also near to the side of the positive pole 3, of the latter part. According to this example, an application of at least one kind of metal, smaller in sputtering ratio, which belongs to the group R, to the cylinder of the control electrode 5 to which impact of the ions is given will reduce amount of generated impurities. Similarly, a construction not only of providing the cylinder of the control electrode 5 with a part mainly comprising titanium but also of making a portion of the part, located at the side of the positive pole 3, shorter than another portion of a part, located at the side of the positive pole 3, which is made of at least one kind of metal belonging to the group R, permits the attachment generated by the sputtering to be unable to be easily separated and reduces sputtered amount from the former part to the side of the center line of the positive pole, also thereby reducing amount of the impurities which are occurred from the former part.

FIG. 6-D, FIG. 6-F and FIG. 6-H show that a part, located at the platelike side, of the cylinder of the control electrode 5 is made of disposing alternately a part made of material mainly comprising titanium and another part made of at least one kind of metal belonging to the group R in an azimuth direction of the through hole of the control electrode 5 and a full circumference of a part, located at the side of the positive pole 3, of the cylinder of the control electrode 5 is made of at least one kind of metal which belongs to the group R. According to this example, an application of the metal, smaller in sputtering ratio, which belongs to the group R to the full circumference of the part, located at the side of the positive pole 3, of the cylinder of the control electrode 5 to which impact of the ions is markedly given, reduces amount of generated impurities. Similarly, a construction of providing the side of the platelike part of the cylinder of the control electrode 5 with a part mainly comprising titanium makes it uneasy that the attachment, generated by the sputtering, is separated and a movement of the sputtered surface substance from the part made mainly of titanium to the area near to the center line of the hollow part of the positive pole 4 becomes difficult, thereby reducing amount of the impurity ions which pass through the ion injection hole.

FIG. 6-E and FIG. 6-I show that the cylinder of the control electrode 5 is made of the alloy of titanium and niobium. An application of niobium, smaller in sputtering ratio, to the cylinder of the control electrode 5 to which impact of ions is markedly given reduces the generated impurities and a further application of titanium to the afore-mentioned part of the cylinder makes it difficult that the attachment, generated by the sputtering, is separated. All the existing niobium are 93 for mass number and their isotopes, different in mass number from one another do not exist. For this reason, a merit of applying the alloy including niobium to the cylinder of the control electrode 5 is that any worse influence upon the surface analysis dose not take place, if it is already found that the sample does not contain niobium.

FIGS. 6-A to 6-J illustrate examples of the control electrode 5. It is possible to apply the same construction to the 2nd negative pole and, in that case, the same effect as produced by the control electrode 5 may be obtained.

FIGS. 7-A to 7-E illustrate constructions, different from those of FIGS. 5-A to 5-J, of the 2nd negative pole 7 which is principal part of the present invention. All of FIGS. 7-A, 7-B, 7-C, 7-D and 7-E are longitudinal sectional views. In these cases, it is assumed that the positive pole 3 (not shown) is disposed at left side of the 2nd negative electrode 7.

As shown in these Figures, all the examples of the 2nd negative pole 7 form the sectional area of the section perpendicularly of the magnetic field of the ion injecting hole 8 adjacent to the hollow part 4 of the positive pole, i.e., in the opening located at the left side of the drawing, larger than the sectional area of the inner side of the second negative pole 7.

Next, a specific description of the shapes of the negative pole 7 is made in conjunction with FIG. 7-A to FIG. 7-E:

Referring first to FIG. 7-A, the ion injecting hole 8 of the 2nd negative pole 7 is constructed of 2 cylindrical spaces which are different in diameter. In this example of the shape, a section perpendicular of the magnetic field of the ion injecting hole 8 has its portion near to the side of the hollow part 4 of the positive pole, i.e. opening at the left side of the drawing, made larger in area than a section in the inner side of the 2nd negative pole 7 adjacent to the former section, i.e. in the right side of the drawing wherein the ions are injected from a group of discharge electrodes. Such a shape of the ion injecting hole 8 enables a ratio of injecting particles, emitted from the surface of the 2nd negative pole 7, by way of the ion injecting hole 8 from a group of discharge electrodes to be reduced. For this reason, a rate of occupying the particles which are emitted from the surface of the 2nd negative pole 7 by the sputtering with the particles which are injected by way of the ion injecting hole 8 from a group of the discharge electrodes becomes smaller so that amount of impurity ions being generated from the surface substance of the 2nd negative pole 7 can be reduced.

In FIG. 7-B, the inner part of the ion injecting hole 8 of the 2nd negative pole 7 is of truncated cone wherein diameter of the ion injecting hole 8 is reduced more and more together with becoming more distant from the positive pole 3 in a proportional manner. Also in FIG. 7-C, whose example is the same as that of FIG. 7-B, its different point from FIG. 7-B is featured by that the inside of its ion injecting hole 8 has 3 spaces of a truncated-cone-shape. An adaption of the ion injecting hole 8 to be of such a shape may obtain the same effect as shown in FIG. 7-A.

In FIG. 7-D, the diameter of the ion injecting hole 8 of the 2nd negative pole 7 is gradually decreased together with becoming more distant from the positive pole 3 in a proportional manner. Such a shape may be expected to obtain the same effect as shown in FIGS. 7-A to 7-C or the same over the cases of these Figures.

In the example of FIGS. 7-A to 7-D, although the ion injecting hole 8 is formed to minimize its diameter at its part of injecting the ions from a group of discharge electrode, i.e. at the right sides of the Figures, that is not always necessary condition. As shown in FIG. 7-E, for example, it may be also accepted to make an opening such that its diameter becomes larger at the part of injecting the ions from a group of discharge electrodes. A point is only that an area of the section taken perpendicularly of the magnetic field of the ion injecting hole 8 of the 2nd negative pole 7 in the opening at the side of the hollow part 4 of positive pole ought to be larger than that of the section in the inner side, adjacent to the aforementioned opening, of the 2nd negative pole 7.

Figure 8:
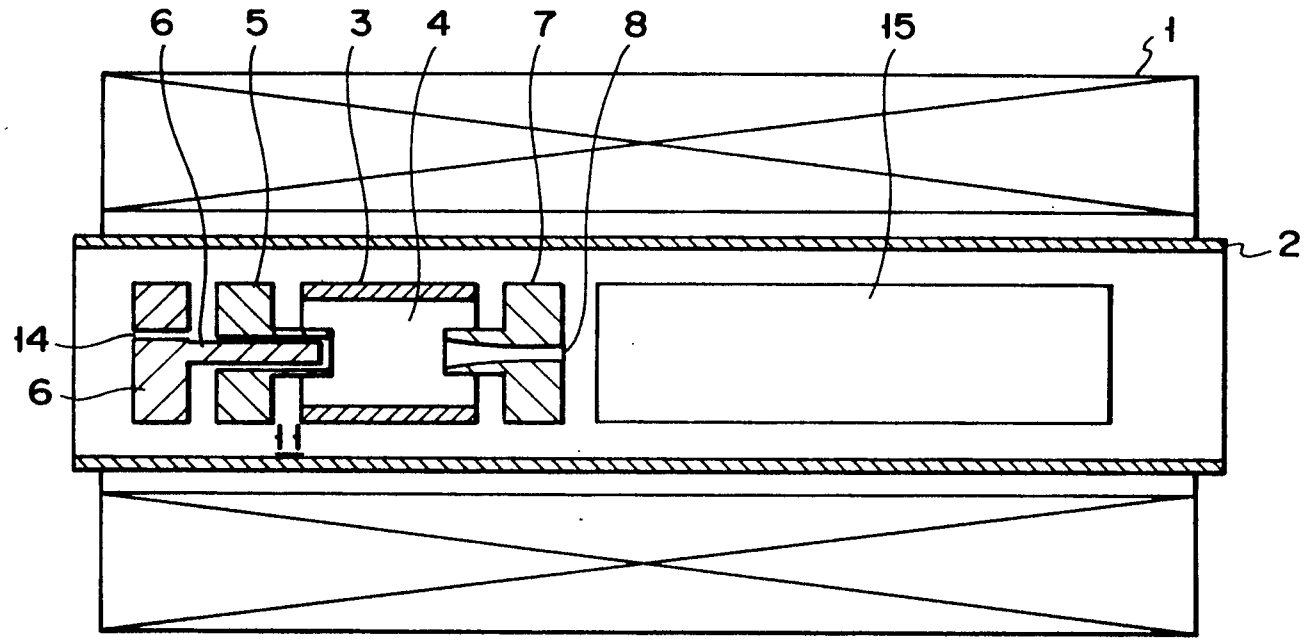
FIG. 8 is a block diagram of the ion source equipment of the 4th embodiment using the ion generating apparatus according to the present invention.

FIG. 8 is a block diagram of the ion source equipment of the 4th embodiment using the ion generating apparatus according to the present invention. The principal part of the ion generating apparatus is therein shown in a manner of a longitudinal sectional view, while other parts thereof are shown in a manner of a block diagram.

In FIG. 8 the electromagnet 1, the vacuum container 2, the positive pole 3 having the hollow part 4, the control electrode 5, and the 2nd negative pole 7 having the ion injecting hole 8 are the same as found in the ion generating apparatus in use for the surface analyzer of FIG. 1. In this embodiment the 1st negative pole 6 is provided with a gas passage 14, which, being a long hole, penetrates the 1st negative pole 6. Such a gas passage 14 constitutes some parts of a gas supply line for supplying the gas to be ionized to the hollow part of the positive pole 4 and the gas to be ionized is supplied by way of a pipe (not shown) penetrating a wall of the vacuum container 2 to one end of the gas passage 14. The gas passing through the gas passage 14 reaches the hollow part 4 of the positive pole by way of the hollow part of the control electrode 5 and its partial portion is ionized by a group of electrons existing in the hollow part 4 of the positive pole.

On the other hand, an ion beam forming part 15 is disposed by way of the 2nd negative pole 7 at the side opposite to the positive pole 3. Some portions of gas ions, generated in the hollow part 4 of the positive pole, passing through the ion injecting hole 8 of the 2nd negative pole 7, commence their incidence into the ion beam forming part 15, where they become partially the ion beam, such an ion beam being determined its magnitude and its moving direction. It is already known that features of the crossed-field discharge type gas ion source equipment include higher gas efficiency, rate between flowrate of the injected ion and that of the introduced gas. Such a phenomenon may be applied to the gas ion source equipment having the ion generating apparatus of the present invention wherein the crossedfield triode discharge is used. According to the ion source equipment of the embodiment, the beam of the gas ion, having only quite small amount of impurities and being high in gas efficiency, can be formed.

Figure 9:
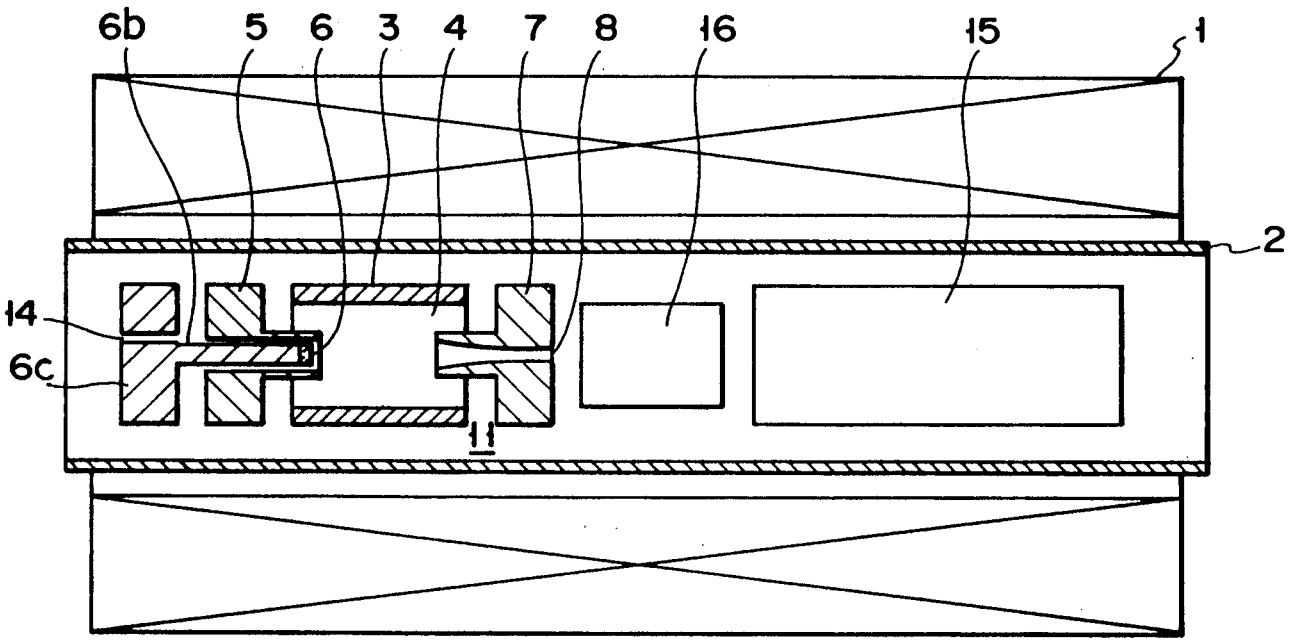
FIG. 9 is a block diagram of the ion source equipment of the 5th embodiment using the ion generating apparatus according to the present invention.

FIG. 9 is a block diagram of the ion source equipment of the 5th embodiment using the ion generating apparatus according to the present invention and the principal part of the ion generating apparatus is shown in a manner of a longitudinal sectional view, while other parts are shown in a manner of a block diagram. Other than the 1st negative pole 6 and the ion-mass separator 16, the construction of FIG. 9 is the same as shown in FIG. 8.

According to the embodiment, the substance 6*c* to be ionized is disposed at the part of the rodlike piece 6*b*, facing the hollow part of the positive pole 4, of the 1st negative pole 6.

On the other hand, the ion-mass separator 16 permits ionic mass of the gas which has been supplied by way of the gas passage 14, the long hole penetrating the 1st negative pole 6, to the hollow part 4 of the positive pole and ionic mass of the substance 6c to be ionized to be separated from each other. In the ion-beam forming part 15, ion-beam, whose magnitude and moving direction are determined, of the substance 6c to be ionized is formed. The ion source equipment of the embodiment enables the beam of ion, of solid origin, which has few amount of impurities, to be generated.

Figure 10:
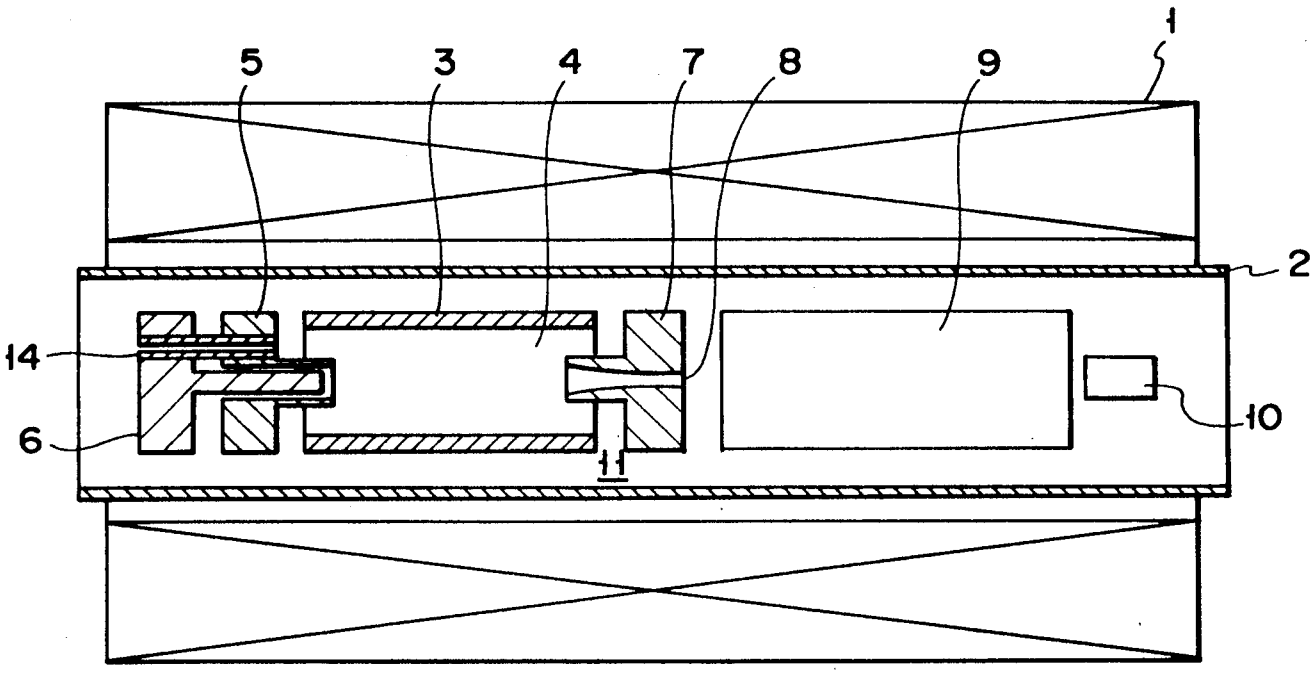
FIG. 10 is a block diagram of the mass spectrometer of the 6th embodiment using the ion generating apparatus according to the present invention.

FIG. 10 is a block diagram of the mass analyzer of the 6th embodiment using the ion generating apparatus according to the present invention. The electromagnet 1, the vacuum container 2, the positive pole 3 having the hollow part 4, and the 2nd negative pole 7 having the ion injecting hole 8 are the same in construction as found in the ion generating apparatus used by the surface analyzer of FIG. 1.

The gas passage 14, made of insulating pipe, penetrates the control electrode 5 and the 1st negative pole 6. The pipe (not shown) penetrating the wall of the vacuum container 2 allows the gas whose mass is analyzed to be supplied to one end of the gas passage 14 made of the insulating pipe. The gas passing through the gas passage 14 reaches the hollow part 4 of the positive pole and its partial portion is ionized by a group of electrons existing in the hollow part 4 of the positive pole.

In vicinity of the ion injecting hole 8 of the 2nd negative pole 7, the ion-mass separator 9 is disposed to be on side opposite to the positive pole 3 by way of the 2nd negative pole 7. The ion generating apparatus, the ion-mass separator 9, and the ion-current measuring unit 10 constitute a means of analyzing ionic mass, and the means of analyzing ionic mass and the ion generating apparatus are combined to constitute the mass spectrometer. Namely, some portions of ions of the gas to be analyzed, being generated in the hollow part 4 of the positive pole, pass through the ion injecting hole 8, and make their incidence into the ion-mass separator 9, thereby analyzing the ionic mass. The mass spectrograph of the embodiment, being superior in SN ratio, can perform the mass spectrometry of high sensitivity.

Figure 11:
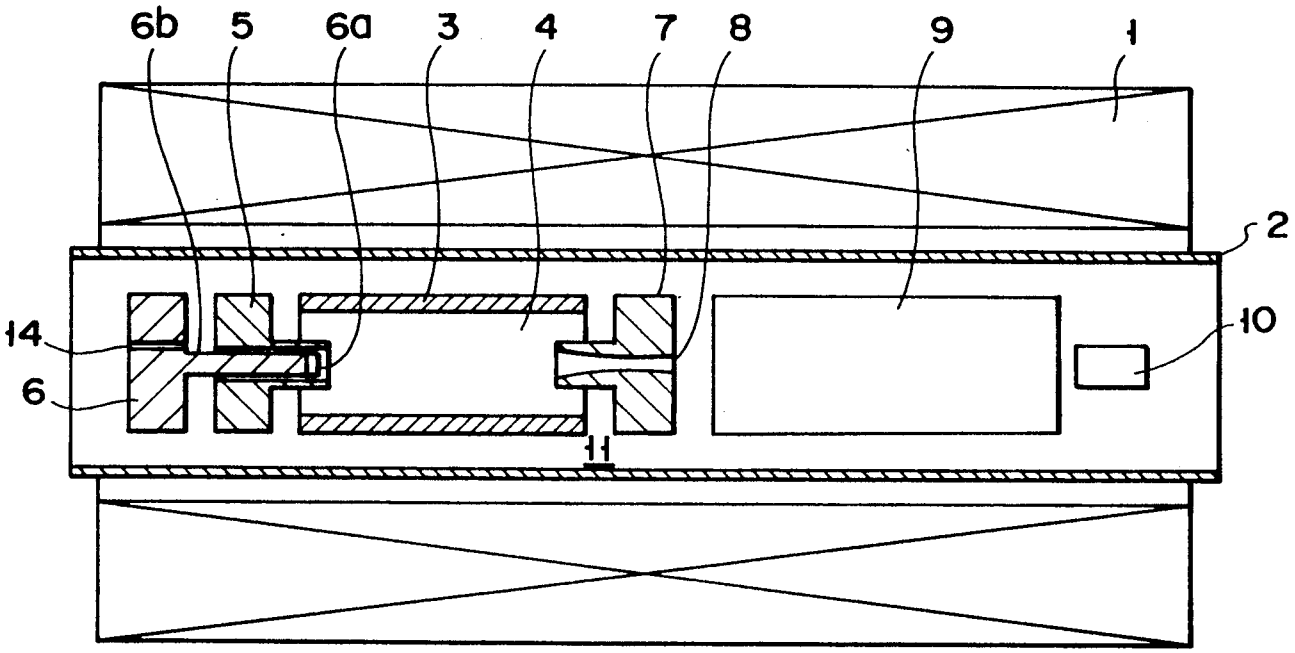
FIG. 11 is a block diagram of the surface analyzer of the 7th embodiment using the ion generating apparatus according to the present invention.
Figure 12:
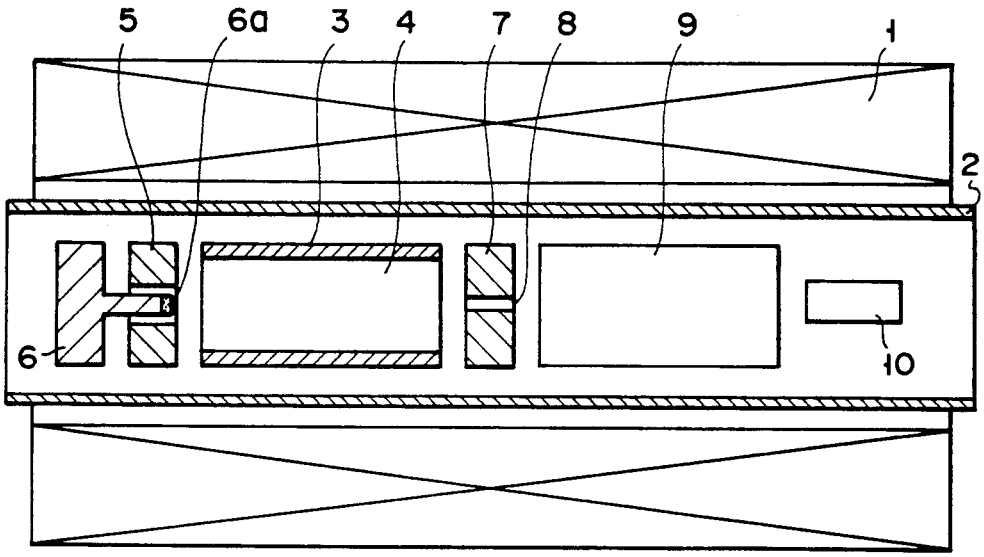
FIG. 12 PRIOR ART
FIG. 12 is a block diagram of the conventional surface analyzer.
Figure 13:
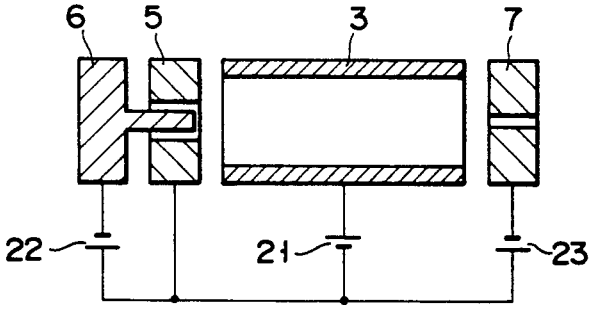
FIG. 13 PRIOR ART
FIG. 13 is a power connection diagram illustrating a relationship among electric potentials of electrodes of the ion generating apparatus of FIG. 12.

FIG. 11 is a block diagram of the surface analyzer of the 7th embodiment using the ion generating apparatus according to the present invention and such a surface analyzer is different in the 1st negative pole 6 from the ion source equipment of FIG. 9. The ion-mass separator 16 and the ion-beam forming part 15 of the ion source apparatus as shown in FIG. 9 do not exist in the surface analyzer of FIG. 11. Other than a construction that the means of analyzing ion-mass comprises the ion generating apparatus, the ion-mass separator 9 which is disposed on the side opposite to the positive pole 3 by way of the2nd negative pole 7 in vicinity of the ion injecting hole 8 of the 2nd negative pole 7, and the ion-current measuring unit 10, the construction of FIG. 11 is the same as shown in FIG. 9.

The substance whose surface is to be analyzed, i.e. the sample 6a is disposed on the position, facing the hollow part 4 of the positive pole, of the rodlike part 6b of the 1st negative pole 6. Some portions of the gas which is supplied by way of the gas passage 14 of a long-hole-shape penetrating the 1st negative pole 6 to the hollow part 4 of the positive pole are ionized by a group of electrons which exist in the hollow part of the positive pole 4. Some portions of such ions of generated gas as mentioned above irradiate the surface of the sample 6a, thereby commencing the sputtering process. Some portion of the surface substance of the sample, emitted by the sputtering, are ionized by a group of electrons existing in the hollow part of the positive pole 4, injected from the ion injecting hole, and their incidence into the ion-mass separator 9 is made, whereby their mass is analyzed and the surface analysis of the sample 6a is performed. The surface analyzer of the embodiment, being superior in SN ratio, can perform the surface analysis of high sensitivity.

As mentioned above, according to the present invention, the following effects may be obtained:

(1) In the case where the ion generating apparatus is in use for the surface analyzer, while disposing the sample to be analyzed its surface on the negative pole, the analytical sensitivity of the surface substance of the sample can be enhanced and amount of generating the impurities is reduced to make SN ratio higher, thereby improving the analytical sensitivity.

(2) In the case of being used as the gas-ion source equipment, the impurities are reduced and the gas efficiency can be enhanced.

(3) In the case of being used as the sputtering type equipment of generating ions of solid origin, it is possible to enlarge value of the output ion beam current of the solid substance to be ionized and to reduce amount of impurity ions contained by the ion beam which is injected from the ion injecting hole.

(4) In the case of being used as the mass spectrograph, an improvement in SN ratio and an enhancement of the analytical sensitivity are possible.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An ion generating apparatus comprising:

a vacuum container connected to a vacuum unit;

magnetic field generating means, for generating magnetic field to be applied into said vacuum container;

a positive pole, having a hollow part whose ends are opened and, which is disposed in said magnetic field such that a center line of said hollow part is in parallel with a direction of said magnetic field;

a first negative pole, disposed opposite to one opening of said hollow part, which has a rodlike part extending toward said positive pole and coaxial with the center line of said hollow part;

a second negative pole, disposed opposite to another opening of said hollow part, which has an ion injecting hole located at a positive where an axis of said second negative pole intersects with said center line of said hollow part;

a control electrode disposed either between said positive pole and said first negative pole or between said positive pole and said second negative pole; and means for applying a highest electric potential of all the electrode and poles to said positive pole, and an electric potential higher than those of said first and second negative poles to said control electrode, at least either said control electrode or said second negative pole further comprises:

a cylinder having a through hole coaxial with said hollow part, said cylinder having first and second ends; and a platelike part provided on the first end of said cylinder, wherein said cylinder has a part made of at least one kind of metal belonging to a group consisting essentially of vanadium, chromium, niobium, molybdenum, tantalum and tungsten; and at least one of said control electrode, said first negative pole, and said second negative pole has a part made of titanium.

2. An ion generating apparatus, according to claim 1, wherein said cylinder has an annular part, facing said through hole and located at a side of said positive pole, made of at least one kind of metal belonging to said group, and at least another part made of material mainly consisting essentially of titanium.

3. An ion generating apparatus, according to claim 2, wherein the second end of the cylinder has thinner walls than the first end.

4. An ion generating apparatus, according to claim 1, wherein said cylinder has an inner surface near said second end made of material mainly consisting of titanium and another inner surface of said cylinder is made of a member of said group.

5. An ion generating apparatus, according to claim 4, wherein the outer diameter of the second end of the cylinder is thinner than the outer diameter of the first end.

6. An ion generating apparatus, according to claim 2, wherein said cylinder is constructed such that said annular part made of at least one kind of metal belonging to said group and said at least another part made of material mainly consisting essentially of titanium are disposed alternately in an adjacent manner in an azimuth direction of the through hole.

7. An ion generating apparatus, according to claim 6, wherein said at least another part located toward the second end is made of material mainly consisting essentially of titanium and is tapered so that a surface thereof at the second end is thinner than adjacent portions of said cylinder.

8. An ion generating apparatus, according to claim 6, wherein said at least another part is made of material mainly consisting of titanium, and is shorter than the rest of the cylinder.

9. An ion generating apparatus, according to claim 1, wherein a portion of the cylinder near said platelike part comprises:

a first cylinder part made of at least one kind of metal belonging to said group and a second cylindrical part made of material mainly consisting essentially of titanium, the first and second parts disposed alternately in an adjacent manner along an azimuth direction.

10. An ion generating apparatus, according to claim 1, wherein said cylinder is mainly comprised of an alloy of titanium and niobium.

11. An ion generating apparatus comprising:

a vacuum container connected to a vacuum unit;

magnetic field generating means, for generating a magnetic field to be applied into said vacuum container;

a positive pole, having a hollow part whose ends are opened and which is disposed in said magnetic field such that a center line of said hollow part is in parallel with a direction of said magnetic field;

a first negative pole, disposed opposite to one opening of said hollow part, which has a rodlike part extending toward said positive pole and coaxial with said center line of said hollow part;

a second negative pole, disposed opposite to another opening of said hollow part, which has an ion injection hole located at a position where an axis of said second negative pole intersects said center line of said hollow part;

a control electrode disposed at either position between said positive pole and said first negative pole or between said negative pole and said second negative pole; and means for applying a highest electric potential of all the electrode and poles to said positive pole, and an electric potential higher than those of said first and second negative poles to said control electrode, wherein said ion injecting hole has a cross-section which tapers so that the injection hole at an end of the second negative pole which is closest to the positive pole has a largest cross-section thereof.

* * * * *